United States Patent [19]

Jaeckh et al.

[11] 4,165,232

[45] Aug. 21, 1979

[54] MANUFACTURE OF FERROMAGNETIC METAL PARTICLES ESSENTIALLY CONSISTING OF IRON

[75] Inventors: Christof Jaeckh, Heidelberg; Werner Steck, Mutterstadt; Rudolf Brodt, Hirschberg; Manfred Ohlinger, Frankenthal; Werner Loeser, Ludwigshafen; Eberhard Koester, Frankenthal, all of Fed. Rep. of Germany

[73] Assignee: BASF Aktiengesellschaft, Fed. Rep. of Germany

[21] Appl. No.: 942,656

[22] Filed: Sep. 15, 1978

[51] Int. Cl.[2] ..... C22C 1/04

[52] U.S. Cl. ..... 75/0.5 AA; 75/0.5 BA; 148/105; 252/62.55; 427/127; 428/900

[58] Field of Search ..... 75/123 B, 0.5 AA, 0.5 BA; 148/105; 252/62.55, 62.56; 427/127; 428/900

[56] References Cited

U.S. PATENT DOCUMENTS

| | | | |
|---|---|---|---|
| 2,974,104 | 3/1961 | Paine et al. | 252/62.5 |
| 3,652,334 | 3/1972 | Abeck et al. | 252/62.56 |
| 3,837,839 | 9/1974 | Rau et al. | 75/0.5 AA |
| 3,902,888 | 9/1975 | Aonuma et al. | 75/0.5 AA |
| 3,966,510 | 6/1976 | Aonuma et al. | 75/0.5 AA |
| 4,050,962 | 9/1977 | Koester et al. | 75/0.5 BA |
| 4,067,755 | 1/1978 | Umeki et al. | 75/0.5 AA |
| 4,069,073 | 1/1978 | Tadokoro | 252/62.56 |
| 4,069,367 | 1/1978 | Umeki et al. | 75/0.5 AA |
| 4,096,316 | 6/1978 | Tamai et al. | 75/0.5 AA |
| 4,101,311 | 7/1978 | Aonuma et al. | 75/0.5 AA |

FOREIGN PATENT DOCUMENTS

| | | | |
|---|---|---|---|
| 2014500 | 12/1970 | Fed. Rep. of Germany | 75/0.5 AA |
| 2212934 | 3/1972 | Fed. Rep. of Germany | 75/0.5 AA |
| 1902270 | 4/1975 | Fed. Rep. of Germany | 75/0.5 AA |
| 1907691 | 4/1975 | Fed. Rep. of Germany | 75/0.5 AA |
| 47-16052 | 12/1972 | Japan | 75/0.5 AA |

OTHER PUBLICATIONS

Oppegard et al., "Magnetic Properties of Single-Domain Iron and Iron-Cobalt Particles Prepared by Borohydride Reduction", *Journal of Applied Physics*, Supplement to vol. 32, No. 3, Mar. 1961, pp. 1845-1855.

Kneller, *Ferromagnetismus*, Springer-Verlag, Berlin (1962), pp. 437-439.

Luborsky et al., "Crystallographic Orientation and Oxidation of Submicron Whiskers of Iron, Iron-Cobalt and Cobalt", Journal of Applied Physics, vol. 34, No. 9, Sep. 1963, pp. 2905-2909.

*Primary Examiner*—L. Dewayne Rutledge
*Assistant Examiner*—Peter K. Skiff
*Attorney, Agent, or Firm*—Keil & Witherspoon

[57] ABSTRACT

A process for the manufacture of acicular ferromagnetic metal particles which essentially consist of iron and carry, on their surface, from 0.02 to 0.6% by weight of boron in the form of a borate, by reducing an acicular iron oxide with a gaseous reducing agent at from 250° to 500° C., wherein a compound selected from the group comprising boron oxyacids and their inorganic salts is precipitated on the said iron oxide before reduction.

2 Claims, No Drawings

MANUFACTURE OF FERROMAGNETIC METAL PARTICLES ESSENTIALLY CONSISTING OF IRON

The present invention relates to a process for the manufacture of ferromagnetic metal particles essentially consisting of iron, which are distinguished by a narrow particle size distribution coupled with pronounced acicular shape, by reducing an acicular iron oxide with a gaseous reducing agent.

Because of their high saturation magnetization and the high coercive force achieved, ferromagnetic metal powders and thin metal layers are of particular interest for the manufacture of magnetic recording media. This is because they permit a substantial increase in the energy product and the information density, which means, inter alia, that using such recording media narrow signal widths and better signal amplitudes than the conventional standard can be achieved. Thin metal layers have the further advantage over pigments that the ideal packing ratio of 1.0 is achievable since, unlike the case of pigments, a binder is not needed. However, the said metal layers are expensive to produce and in particular their use as a tape recording medium presents problems because of the mechanical characteristics of the tape. At the optimum layer thickness of about 1 $\mu$m or less, the surface of the layer must be very smooth, because of head/tape contact, where the slightest abrasion, or even dust alone, can be destructive.

It is true that when using metal powders as magnetic pigments the mechanical properties of the recording medium can be varied within wide limits by suitable selection of the binder system, but the metal pigments have to conform to specific requirements in respect of shape, size and dispersibility.

Since a high coercive force and high residual induction are preconditions for magnetic pigments used in magnetic memory layers, the corresponding metal pigments must exhibit magnetic single-domain characteristics, and furthermore the existing anisotropy, or the anisotropy additionally achievable by magnetic orientation in the tape, should be relatively insensitive to external factors, for example temperature or mechanical stress, ie. the small particles should exhibit shape anisotropy, preferably by being acicular, and should in general have a size of from $10^2$ to $10^4$ Å.

The patent literature discloses numerous processes for the manufacture of magnetic metal particles. For example, in the process of U.S. Pat. No. 2,974,104 magnetic particles are deposited by electroplating a liquid mercury cathode with iron from an electrolyte solution. Thereafter, the particles must be separated from the mercury by an expensive process.

The reduction of, for example, iron salts with hydrides (J. Appl. Phys., 32 (1961), 184 S) and vacuum vaporization of metals, followed by deposition as whiskers (J. Appl. Phys., 34 (1963), 2905) have also been disclosed, but are not relevant to industrial practice. The manufacture of metal powders of the above type by reducing finely divided acicular metal compounds, eg. oxides, with hydrogen or some other gaseous reducing agent, has also been disclosed. In order that the reduction shall take place at an industrially useful rate, it must be carried out at above 350° C. This however entails the difficulty that the metal particles formed will sinter. As a result, the particle shape no longer conforms to what is required from the point of view of the magnetic properties. It has already been proposed to lower the reduction temperature by applying silver or silver compounds to the surface of finely divided iron oxide in order to catalyze the reduction (German Laid-open Application DOS No. 2,014,500). Modification of the iron oxide, to be reduced, with tin (German published application DAS No. 1,907,691), with cobalt/nickel (German published application DAS No. 2,212,934) and with germanium, tin or aluminum (German published application DAS No. 1,902,270) have also been disclosed. However, the effect of the said metals on the reduction of the acicular starting compounds is in general to give much smaller needles than the starting material, and furthermore the needles have a lower length/width ratio. The result of this is that the end product exhibits a rather broad particle size spectrum and, coupled therewith, a broad distribution of shape anisotropy. However, the literature discloses that the coercive force and residual induction of magnetic materials is very dependent on the particle size when the latter is of the order of magnitude of single-domain particles (Kneller, Ferromagnetismus, Springer-Verlag 1962, page 437 et seq.). If to this are added the factors resulting from the presence of a proportion of superparamagnetic particles, which may be formed as fragments during the above procedure, then such magnetic particles are highly unsuitable for use in the manufacture of magnetic recording media, for example because of their poor maximum output level at long wavelengths. With such heterogeneous mixtures the magnetic field strength required to reverse the magnetization of the particles varies greatly and the distribution of the residual magnetization as a function of the applied external field also results in a rather flat residual induction curve.

It is an object of the present invention to provide a suitable process for the manufacture of acicular ferromagnetic metal particles which are distinguished by a narrow particle size spectrum coupled with pronounced acicular shape of the particles and which therefore exhibit high coercive force, a very steep residual induction curve and little temperature dependence of magnetic properties.

We have found that this object is achieved and that acicular ferromagnetic metal particles essentially consisting of iron conform to the above requirements if the surface of the metal particles carries boron, in the form of a borate, in an amount of from 0.02 to 0.6% by weight, based on the metal content of the particles.

According to the invention, these metal particles, consisting essentially of iron, are manufactured by reducing a finely divided acicular iron oxide with a gaseous reducing agent at from 250° to 500° C., from 0.01 to 1% by weight of boron, based on iron oxide, in the form of a boron oxyacid or an inorganic salt thereof, being deposited on the iron oxide before reduction.

All acicular iron oxides are suitable starting materials for the manufacture of the metal particles of the invention, which essentially contain iron. Preferably, these oxides are selected from the group comprising alpha-FeOOH, gamma-FeOOH, mixtures of these or iron oxides obtained from them by dehydration or heating, $Fe_3O_4$, gamma-$Fe_2O_3$ and mixed crystals of these, and alpha-$Fe_2O_3$. These oxides may also be used for the manufacture of ferromagnetic metal particles if they contain other elements, provided that the latter do not interfere with the acicular shape. Particularly advantageous ferromagnetic particles contain iron and up to 25 atom per cent of cobalt.

For the purposes of the present invention it has proved particularly advantageous to employ acicular goethite, lepidocrocite or mixtures of these, with a mean particle length of from 0.1 to 2 μm, preferably from 0.2 to 1.2 μm, a length/width ratio of from 15:1 to 50:1, and a specific surface area, $S_{N2}$, of from 24 to 80 $m^2$, preferably from 27 to 75 $m^2/g$. The dehydration products of the above hydrated iron(III) oxides may be used similarly, the dehydration advantageously being carried out in air at from 200° to 600° C.

A boron oxyacid or a salt thereof is now applied, according to the process of the invention, to one of the above iron oxides. Examples of suitable compounds are $H_3BO_3$, $HBO_2$, $B_2O_3$, $Na_2B_4O_7.4H_2O$, $Na_2B_4O_7.10H_2O$, $NaBO_2$, $KBO_2$ and $KB_5O_8.4H_2O$.

In developing the process of the invention it has proved particularly advantageous to employ acicular goethite, lepidocrocite or mixtures of these having a mean particle length of from 0.1 to 2 μm, preferably from 0.2 to 1.2 μm, a length/width ratio of from 15:1 to 50:1 and a specific surface area, $S_{N2}$, of from 24 to 80 $m^2$, preferably from 27 to 75 $m^2/g$, which have not only been treated with one of the above boron compounds but also with a phosphorus oxyacid or an inorganic salt thereof, in an amount of from 0.1 to 0.7% by weight of phosphorus, based on the iron oxide, and with an aliphatic monobasic or polybasic carboxylic acid of 1 to 6 carbon atoms, in an amount of from 0.1 to 1.2% by weight of carbon, based on iron oxide. Reduction of such a material gives metal particles which in addition to boron in the form of a borate also carry from 0.1 to 0.7% by weight of phosphorus in the form of a phosphate and carbon in an amount of from 0.02 to 0.2% by weight. This additional treatment may be carried out with phosphoric acid, a soluble salt of orthophosphoric acid, eg. potassium orthophosphate, ammonium orthophosphate, disodium orthophosphate, dilithium orthophosphate or trisodium orthophosphate; a diphosphate, especially sodium pyrophosphate, or a metaphosphate, eg. sodium metaphosphate. The compounds may be used individually or as mixtures with one another. The carboxylic acids may be saturated or unsaturated aliphatic carboxylic acids of up to 6 carbon atoms and with up to 3 acid radicals, with the hydrogens of the aliphatic chain being unsubstituted or one or more of the hydrogens being substituted by hydroxyl or amino. Particularly suitable acids are dicarboxylic acids, hydroxydicarboxylic acids and hydroxytricarboxylic acids, et. oxalic acid, tartaric acid and citric acid.

To finish the iron oxide, the latter may be suspended in water or a water-soluble organic solvent, preferably a lower aliphatic alcohol, or in a mixture of this organic solvent with water, but preferably in water alone, by vigorous stirring. The appropriate compounds are added to this suspension of oxide particles. To ensure uniform dispersion, stirring is continued for some time, advantageously for from 10 to 60 minutes, after adding the compounds, and the mixture is then filtered. The finished oxide may then be dried at up to 200° C. in air or under reduced pressure.

The amount of the substances present in the iron oxide suspension is selected so that after the treatment the surface of the dried product carries an amount of additive which is such that after reduction the metal particles carry the amount according to the invention. The concentration required to achieve this can, after selection of the compounds to be used, easily be determined by a few experiments and analytical determinations.

According to the process of the invention, the acicular oxide treated as explained above is reduced to the metal by use of a gaseous reducing agent. This may be carried out in a conventional manner by passing a gaseous reducing agent, preferably hydrogen, over the oxide at up to 500° C., preferably at from 250° to 450° C. Iron needles having a length of from 0.1 to 0.8 μm, with a length/width ratio of from 5:1 to 25:1, may be mentioned as examples of products obtained according to the process of the invention. The metal particles of the invention are distinguished by particularly improved values of both the coercive force and the residual induction, compared to the prior art.

The experiments which follow illustrate the invention.

The coercive force $H_c$[kA/m], the specific remanence $M_{R/\rho}$[$nTm^3/g$] and the saturation magnetization $M_S\rho$[$nTm^3/g$] of the powder samples were measured in a vibrating sample magnetometer at a field strength of 160 kA/m. The coercive force $H_c$ was converted to the value corresponding to the tap density 1.6, in accordance with the equation:

$$H_{c(1.6)}=H_c.6/7.6\text{-}\rho$$

EXAMPLE 1

In six parallel batches A-F, 50 g samples of goethite having a specific surface area, measured by the BET method, of 44.5 $m^2/g$, a particle length of 0.82 μm and a length/width ratio of 35 are suspended in 750 ml of water, with vigorous stirring.

Batch A is filtered off without further treatment, as a Comparative Experiment, and the filter cake is dried at 120° C. under reduced pressure. After reduction with 30 l/h of hydrogen at 350° C. for 8 hours, an acicular iron powder is obtained.

The follwing amounts of boric acid are added to batches B to F:

B: 0.25 g of $H_3BO_3$,
C: 0.5 g of $H_3BO_3$,
D: 1.0 g of $H_3BO_3$,
E: 1.5 g of $H_3BO_3$,
F: 2.0 g of $H_3BO_3$, in each case dissolved in 10 ml of water.

After stirring for a further 10 minutes, the solid is filtered off and the filter cake is dried in air at 120° C. Reduction of this treated goethite at 350° C. in a stream of hydrogen of 30 l per hour for a total of 8 hours gives an acicular iron powder. The results are summarized in Table 1.

TABLE 1

| Batch | Content of B % | Magnetic values at 160 kA/m $H_{c(1.6)}$ | $M_{m/\rho}$ | $M_{r/92}$ | $M_r/M_m$ |
|---|---|---|---|---|---|
| A | — | 54 | 146 | 75 | 0.51 |
| B | 0.03 | 67 | 120 | 67 | 0.56 |
| C | 0.05 | 68 | 119 | 66 | 0.55 |
| D | 0.11 | 70 | 124 | 70 | 0.56 |
| E | 0.16 | 71 | 140 | 79 | 0.56 |
| F | 0.17 | 73 | 135 | 74 | 0.55 |

EXAMPLE 2

In two parallel batches G and H, 50 g portions of alpha-FeOOH having a specific surface area, measured by the BET method, of 42.4 $m^2/g$ are suspended in 750 ml of water, with vigorous stirring.

A mixture of 0.35 ml of 85% strength phosphoric acid and 0.5 g of oxalic acid ($C_2H_2O_4.2H_2O$) in 10 ml of water is added to batch G. After stirring for a further 10 minutes, the solid is filtered off and the filter cake is dried in air at 120° C. Reduction of the treated goethite with 30 l/h of hydrogen at 350° C. for 8 hours gives an acicular iron powder, which serves as a comparative sample.

A mixture of 0.35 ml of 85% strength phosphoric acid, 0.5 g of oxalic acid ($C_2H_2O_4.2H_2O$) and 0.5 g of boric acid in 10 ml of water is added to batch H, which is then worked up as described for batch G.

The analytical data and magnetic values of the iron powders obtained are listed in Table 2.

TABLE 2

| | | Magnetic values at 160 kA/m | | | |
|---|---|---|---|---|---|
| Batch | Content of | $H_{c(1.6)}$ | $M_{m/92}$ | $M_{r/\rho}$ | $M_r/M_m$ |
| G | P = 0.4%<br>C = 0.08% | 71 | 146 | 80 | 0.55 |
| H | P = 0.27%<br>C = 0.053%<br>B = 0.04% | 74 | 136 | 76 | 0.56 |

EXAMPLE 3

5 kg of alpha-FeOOH having a specific surface area, measured by the BET method, of 43.1 $m^2/g$ are introduced, while stirring, into a 60 l vessel containing 40 l of water. After dispersing for 10 minutes, 150 g of boric acid ($H_3BO_3$), dissolved in 3 l of water, are added.

After dispersion has been completed, the water is removed by filtration and the finished hydrated iron-(III) oxide is dried in air at 140° C. The dried pigment contains 0.36% of B.

The treated goethite is reduced to iron powder as described in Example 1.

The iron pigment contains 0.48% of boron. The magnetic values, measured at 160 kA/m, are $H_{c(1.6)}=72.5$
$M_{m/\rho}=136$
$M_{r/\rho}=75$
$M_r/M_m=0.55$

We claim:

1. A method of preparing acicular ferromagnetic metal particles consisting essentially of iron and suitable for magnetic recording, said particles being modified at the surface with 0.02 to 0.6% by weight of boron as borate, by reducing a finely divided acicular iron compound selected from the group consisting of iron oxide and iron oxide hydrate with a gaseous reducing agent at a temperature of from 250° to 500° C., wherein there are deposited on said iron oxide or iron oxide hydrate, prior to reduction, a substance selected from the group consisting of oxyacids of boron and their inorganic salts in such an amount that 0.01 to 1% by weight of boron is present.

2. A method of preparing acicular ferromagnetic metal particles consisting essentially of iron and suitable for magnetic recording, said particles being modified at the surface with 0.02 to 0.6% by weight of boron as borate with 0.1 to 0.7% by weight of phosphorus as phosphate and with 0.02 to 0.2% by weight of carbon, by reducing a finely divided acicular iron compound selected from the group consisting of iron oxide and iron oxide hydrate with a gaseous reducing agent at a temperature of from 250° to 500° C., wherein there are deposited on said iron oxide or iron oxide hydrate, prior to reduction (a) a substance selected from the group consisting of oxyacids of boron and their inorganic salts in such an amount that 0.01 to 1% by weight of boron is present, (b) a hydrolysis-resistant substance selected from the group consisting of oxyacids of phosphorus, and their inorganic salts in such an amount that 0.2 to 2% by weight of phosphorus is present, and (c) a compound selected from the group consisting of aliphatic monobasic, dibasic and tribasic carboxylic acids of from 1 to 6 carbon atoms in such an amount that 0.1 to 1.2% by weight of carbon is present.

* * * * *